United States Patent [19]

Beyl

[11] 4,401,318

[45] Aug. 30, 1983

[54] TOE ABUTMENT MEMBER FOR A SKI BINDING

[75] Inventor: Jean J. A. Beyl, Nevers, France

[73] Assignee: Ste Look, Nievre, France

[21] Appl. No.: 183,356

[22] Filed: Sep. 2, 1980

[30] Foreign Application Priority Data

Sep. 14, 1979 [FR] France ..... 79 22955

[51] Int. Cl.[3] ..... A63C 9/085

[52] U.S. Cl. ..... 280/630; 280/625; 280/634

[58] Field of Search ..... 280/623-632

[56] References Cited

U.S. PATENT DOCUMENTS 3,709,510 1/1973 Gotz ..... 280/628
4,088,343 5/1978 Krob ..... 280/625

FOREIGN PATENT DOCUMENTS 1578849 2/1971 Fed. Rep. of Germany .
Ad.1220819 8/1962 France .
1346751 11/1963 France .
1448642 6/1966 France .
2099849 3/1972 France .
2395046 1/1979 France .

*Primary Examiner*—Robert J. Spar
*Assistant Examiner*—Donald W. Underwood
*Attorney, Agent, or Firm*—Jordan B. Bierman; Linda Bierman

[57] ABSTRACT

Under normal skiing conditions, two lateral arms of a jaw unit cooperate with the toe end of a ski boot in order to maintain the boot in the axis of the ski and are held in position with a force designated as the inherent stiffness of release. When an excessive twisting effort is exerted on the skier's leg, the arms both move in a transverse direction with respect to the ski in order to permit lateral disengagement of the boot. A toe abutment feeler member is in contact with the front end of the boot and cooperates with a spring-loaded piston unit in order to reduce the inherent stiffness of release as well as resistance to torsional disengagement in the event of a forward fall of the skier and/or of an axial thrust exerted by the boot, thus achieving considerably enhanced safety.

14 Claims, 14 Drawing Figures

TOE ABUTMENT MEMBER FOR A SKI BINDING

This invention relates to a toe abutment member for a ski binding of the type in which a jaw of the abutment member is composed of two side arms in cooperating relation with the toe end of the ski boot in order to maintain this latter centered on the ski. The abutment member further comprises a resilient device for ensuring that the arms are normally maintained in the boot-retaining position with a predetermined force designated as the inherent stiffness of release, while nevertheless permitting transverse displacement of said arms so that lateral disengagement of the boot may accordingly take place when an excessive twisting effort is applied to the skier's leg.

In the operation of said toe abutment members, a first difficulty is observed at the time of disengagement during a complex fall in which a forward movement is combined with a twisting movement of the skier. There in fact occurs in such a case a considerable increase in overall stiffness of release of the boot under torsional stress, which is added to the inherent stiffness of release. Moreover, some types of heel-holding member have a tendency during their opening movement to thrust the ski boot towards the front end of the ski, that is, into the toe abutment member. Additional parasitic friction therefore appears in this case between the ski boot and the toe abutment member, thus further increasing the overall stiffness of boot release.

A second difficulty appears when an axial thrust is exerted on the toe abutment member. This thrust may appear either in the event of abrupt braking of the ski or in the event of a faulty length adjustment in which the ski boot is abnormally compressed between the toe abutment member and the heel-retaining member, or else in the event of substantial flexural deformation of the ski which also has a tendency to compress the ski boot between the toe abutment member and the heel-retaining member. In all these cases, lateral disengagement of the ski boot is impeded by the parasitic friction forces which develop between the boot and the toe abutment member.

A number of different solutions have been proposed with a view to solving these problems.

Thus a first known type of toe abutment member is not only capable of pivotal displacement but also of forward displacement towards the front end of the ski in the event of excessive axial force. An abutment member of this type is described, for example, in French Pat. Nos. 1,448,642, 1,346,751 and 77 19894 (publication No. 2,395,046).

The great disadvantage of abutment members of this type lies in the fact that said abutment member escapes towards the front end of the ski under the action of an excessive axial thrust arising from one of the causes mentioned earlier and the ski-boot is abruptly released from the heel-retaining member as a result of a sudden increase in distance between the toe abutment member and the heel-retaining member. This tripping action may take place at a time when no torsional stress is exerted on the skier and therefore at a moment when the skier is not exposed to any danger. Such an action accordingly constitutes an untimely release which is liable to result in serious injuries.

A second solution is proposed in French Pat. No. 71 22859 (publication No. 2,099,849). This patent describes a toe abutment member which decreases in torsional stiffness in the event of a forward fall. To this end, one of the means employed consists in making provision beneath the location of the skier's big toe for an element such as a diaphragm which is sensitive to the increase in pressure produced at the time of a forward fall; the increase in pressure within said element or diaphragm is transmitted to the mechanism which serves to adjust torsional stiffness in order to reduce said stiffness. In all cases, reduction of torsional stiffness can be obtained only by increasing the pressure at the front or toe end of the ski boot, that is to say solely in the event of a forward fall. This device therefore does not operate in the event of a simple axial thrust.

A further drawback attached to this design arises from the fact that, after ski-jumping or passing over a hump, and at the moment when the skier lands flat on his skis, the element which is sensitive to the pressure of the foot is necessarily actuated even if the skier is not in a dangerous situation. The abrupt reduction in stiffness of release which accordingly results may also produce an accidental release.

Another known toe abutment device has been disclosed in German Pat. No. 1,578,849. This device comprises a mechanism adapted to lock the abutment member when the ski is not in use and to unlock said abutment member automatically during engagement of the boot in the ski binding.

This mechanism comprises an axial rod restored elastically to its position of rotational locking of the abutment member when the boot is not within the ski binding. When the skier engages the boot in the binding, the end of the boot exerts a thrust on said rod which then unlocks the abutment member for rotational displacement about its stationary pivot.

This cannot be truly described as a system which permits a reduction in stiffness of release in rotation at the time of a forward fall since this locking system is totally independent of the torsional stiffness mechanism.

Finally, the first Addition No 78 802 to French Pat. No. 1,220,819 discloses a ski binding device comprising a link-rod system associated with an elastic member and so arranged that lifting of the heel of the boot causes the link-rod system to lift under the action of the elastic restoring member and produces correlatively a reduction in the force with which the torsional retaining member is applied at the front end of the ski binding.

This design is subject to disadvantages in that it cannot operate solely under the action of a simple axial thrust and is liable to jam very readily as a result of accumulation of snow or as a result of frost by reason of the existence of a complicated link-rod system placed between the boot and the ski.

The aim of the present invention is to overcome all these disadvantages by providing a toe abutment member having a resistance to torsional release which can be reduced both in the event of a forward fall and in the event of an axial thrust.

To this end and in accordance with the invention, the toe abutment member is provided with a feeler member adapted to be in contact with the front portion of the ski boot. Said feeler member is adapted to cooperate with the resilient device in such a manner as to initiate displacement of the feeler member in the event of a forward fall of the skier and/or of an axial thrust exerted by the ski boot within the jaw unit and to produce action on the resilient device in order to reduce the inherent stiffness of release.

In a first embodiment, the jaw unit is constituted by two lateral arms carried by a body rotatably mounted on a pivot attached to the ski. The resilient device comprises a spring for controlling a piston slidably mounted within the body so as to apply said piston against a profiled surface or cam which is preferably flat and formed on said pivot. The feeler member consists of a small plate having a substantially arcuate concave shape and adapted to cooperate with the toe end of the ski-boot upper. A pair of rods slidably mounted within the body is interposed between the piston head and the feeler member.

It will be readily understood that, under the action of a thrust exerted either at the time of a forward fall of the skier or at the time of an axial thrust produced by a bending movement of the ski, a thrust is in turn exerted on the piston by means of the sliding rods in the direction opposite to the force applied by said piston against the pivot. Depending on the adjustment of torsional stiffness of the abutment member and as a function of the value of thrust exerted on the feeler member, the force which applies the piston against the pivot can be simply reduced whereas the piston remains applied against the cam of the pivot or else the piston can be moved away from the pivot.

In the case just mentioned, the inherent stiffness of release of the abutment member is equal to zero. In all cases, overall stiffness of torsional release of the boot with respect to the ski involving parasitic fraction between said boot and said ski and/or the abutment member is maintained at a substantially constant value.

The jaw of the toe abutment member is preferably adjustable for width in order to obtain perfect contact of the front or toe end of the boot with the lateral arms and with the feeler member.

The two lateral arms are advantageously endowed with a certain freedom of resilient deflection over a limited range of motion in order to ensure that displacement of the feeler member is not hindered by the fact that the ski boot is applied against the jaw unit and therefore cannot move forward, at least in theory. In practice, however, the slight but inevitable elasticity of the material constituting the lateral arms as well as the notnegligible deformability of most ski boots usually permit satisfactory displacement of the feeler member, even if provision is not made for any resilient deflection of the lateral arms.

In a second embodiment which relates to an abutment member of the same type as the member of the first embodiment, the feeler member is adapted to cooperate with the front or toe portion of the sole. Furthermore, said feeler member is constituted by two portions in the form of levers pivotally mounted on the body of the abutment member so as to ensure reduction of the force transmitted by the ski boot to the resilient device.

In a third embodiment, the jaw unit is constituted by two functionally independent lateral arms pivotally mounted on a body which is secured to the ski. The resilient device housed within the body comprises a spring which produces action on a slidably mounted piston so as to apply this latter against profiled surfaces formed on each arm. The feeler member is connected to the piston in such a manner as to ensure that the displacement of said feeler member is transmitted to said piston.

Other features and advantages of the invention will become apparent upon consideration of the following description and accompanying drawings which illustrate the four embodiments chosen by way of example in order to gain a clear understanding of the invention, and in which.

Figure 1:
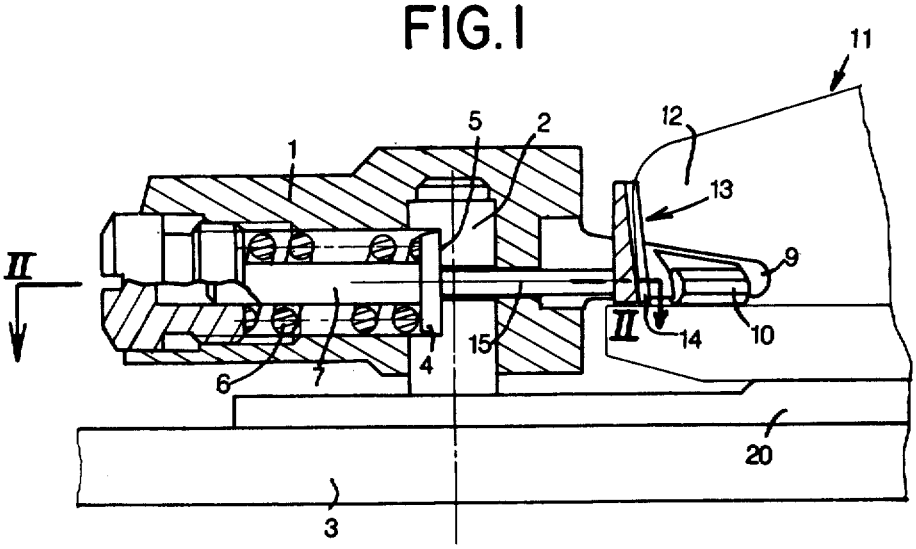
FIG. 1 is a front sectional view taken along line I—I of FIG. 2 and showing a first embodiment of the front or toe abutment member in accordance with the invention.
Figure 2:
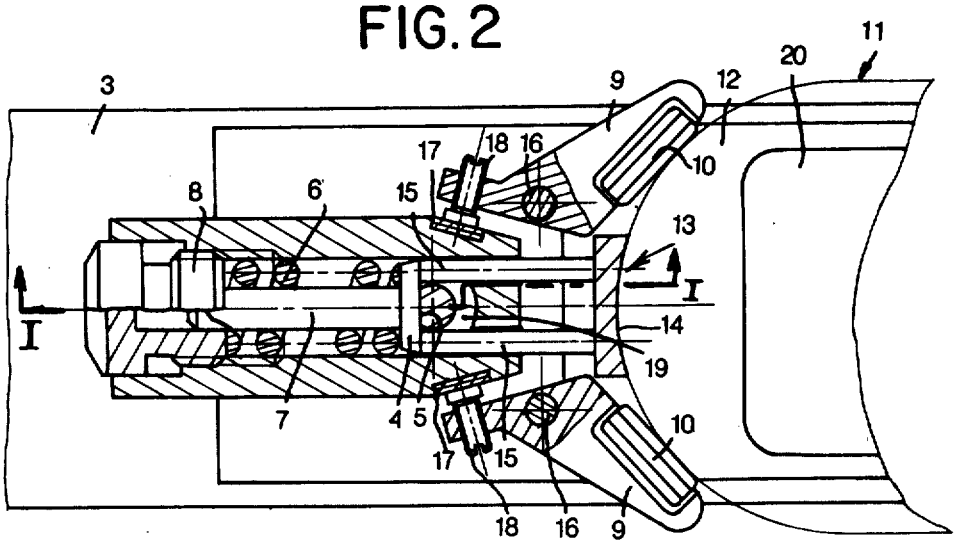
FIG. 2 is a top sectional view taken along line II—II of FIG. 1.

The front end of the ski is located on the left-hand side of each figure.

FIGS. 1 to 4 show a first embodiment in which the toe abutment member for a ski binding contemplated by the invention comprises in known manner a body 1 rotatably mounted on a pivot 2 which is secured to a ski 3 by means not shown in the drawings.

The body 1 contains a resilient device comprising a piston 4 which is urged elastically by means of a helical spring 6 against a profiled surface 5 or flat cam formed on the pivot 2, said helical spring being disposed coaxially with the rod 7 of the piston 4. Said spring 6 is applied against a plug 8 which is screwed into the body 1. The stiffness of release of the toe abutment member can be adjusted by rotating the plug 8.

The jaw unit of the abutment member is constituted by two lateral arms 9 carried by the body 1. The front or toe end of the boot 11 and more precisely the front end of the boot-upper 12 is intended to be applied against said lateral arms 9.

The boot upper is preferably not directly in contact with the arms 9 but with antifriction linings 10 which are secured to these latter. Similarly, the sole of the boot does not rest directly on the ski but on a slide plate 20 which is secured to the ski.

The arms 9 are pivoted to the body 1 about pins 16 and carry screws 18 which are applied against the body 1 by means of seatings 17 formed of elastic material and secured to said body. By rotating the screws 18, the jaw unit constituted by the arms 9 can be closed to a greater or lesser extent in order to adapt the jaw unit to the shape of the toe end of the ski boot.

In accordance with the invention, the abutment member is provided with a feeler member 13 which is adapted to be in contact with the front portion of the toe end of the boot upper 11. Said feeler member cooperates with the resilient device in such a manner as to produce action on the resilient device in order to reduce the stiffness of this latter at the time of a forward fall of the skier or of an axial thrust.

In the example which is illustrated, the feeler member 13 consists of a small plate 14 having a concave face corresponding substantially to a circular arc, the radius of which is substantially equal to that of the ski-boot upper.

A pair of rods 15 is fixed on that face of the small plate 14 which is remote from the ski boot, said rods being disposed parallel to the axis of the ski and slidably mounted within suitable bores formed in the body 1. Those ends of the rods 15 which are directed towards the front end of the ski emerge at the level of the cam 5 on each side of the axis of the pivot 2 in order to be applied against the piston 4. An annular groove 19 formed in the pivot 2 prevents the movement of rotation of the body 1 on the pivot 2 from being hindered by the presence of the rods 15.

A device (not shown in the drawings) is preferably provided for retaining the rods 15 within the body 1 in order to prevent them from passing out of this latter (when no boot is present in the ski binding).

The operation of the embodiment hereinabove described will now be explained.

It should first be recalled that the ski boot is placed between the toe abutment member in accordance with the invention and a rear attachment or heel-holding member which has not been illustrated and the function of which is to retain the heel of the boot against the ski.

Under normal skiing conditions in which the feeler member in accordance with a characteristic feature of the invention does not play any part, the toe abutment member operates in a well-known manner as described, for example, in applicant's French Pat. No. 1,336,704. When the skier's leg is subjected to a twisting movement alone, the toe end of the ski boot produces a lateral displacement of the jaw unit of the toe abutment member and the body 1 rotates on its pivot 2. In this situation (which has not been illustrated but is clearly shown in FIG. 7 of the French patent cited above), the piston 4 is applied against one edge of the flat cam 5 and produces a restoring torque which tends to re-center the boot on the ski.

Under these normal skiing conditions (simple torsion), the boot rests flat on the ski (as shown in FIG. 1) and practically no parasitic friction is set up between the ski boot and the toe abutment member or the slide plate 20. Since resistances arising from friction forces do not exist, the overall stiffness of boot release is therefore equal to the inherent stiffness of the resilient device 6, 4 which is housed within the abutment member, the value of said inherent stiffness having initially beam adjusted so as to take the skier's morphology into account (by operating the adjustment plug 8).

Figure 3:
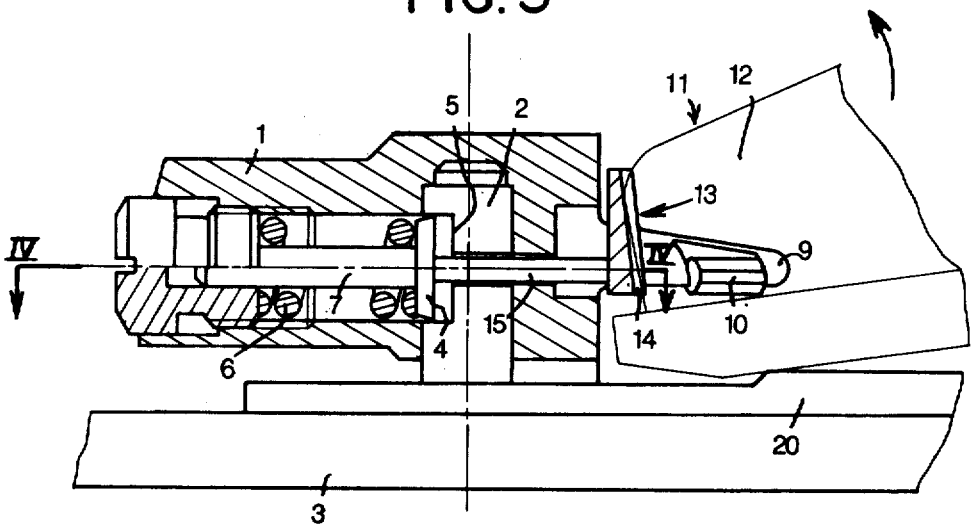
FIG. 3 is a view which is similar to FIG. 1 and shows the position of the feeler member and of the piston of the resilient device at the time of a forward fall.

When the skier is thrown off his balance in the forward direction while skiing, the heel-holding member begins to open and permits lifting of the heel from the ski. The boot then takes up an inclined position as shown in FIG. 3. Since the skier's weight is fully applied against the slide plate, high parasitic friction forces are exerted at this point as well as between the boot and the jaw unit of the toe abutment member, said friction forces being liable to increase the overall boot-release stiffness to a dangerous level.

Figure 4:
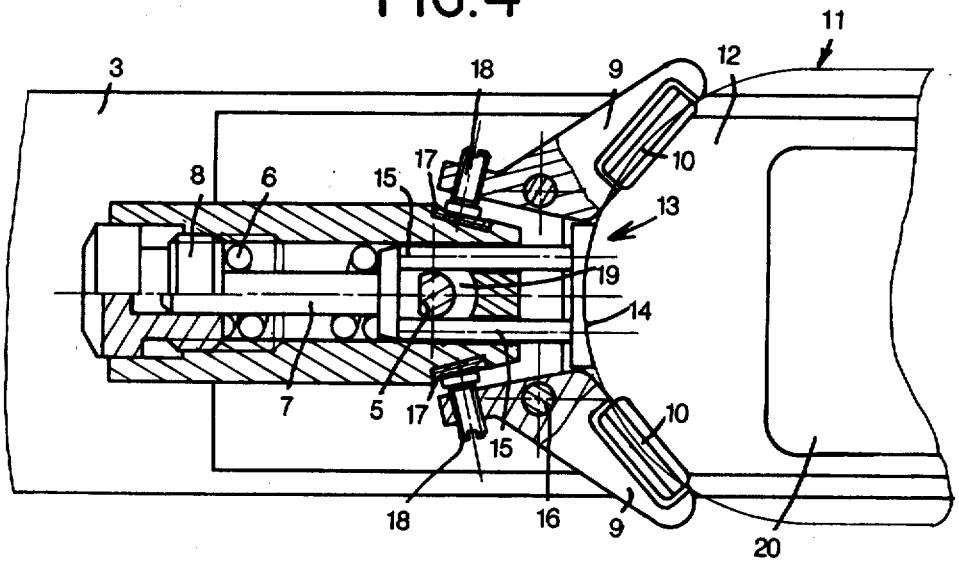
FIG. 4 is a sectional view which is similar to FIG. 2 and is taken along line IV—IV of FIG. 3.
Figure 5:
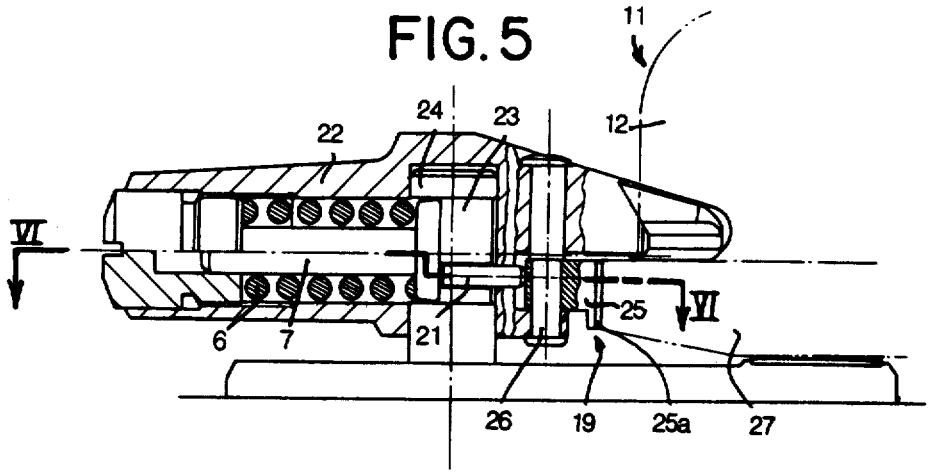
FIG. 5 is a front sectional view taken along line V—V of FIG. 6 and showing a second embodiment of the toe abutment member in accordance with the invention.
Figure 6:
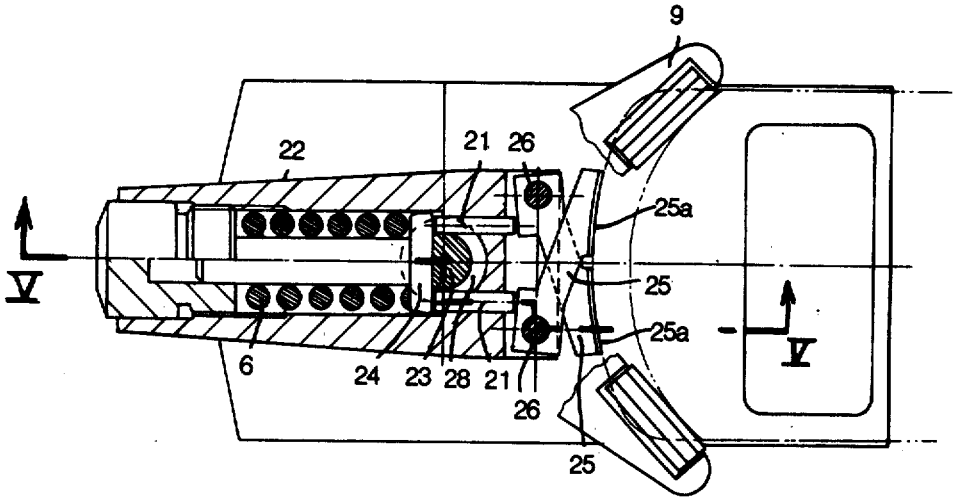
FIG. 6 is a top sectional view taken along line VI—VI of FIG. 5.

However, by reason of the fact that the ski boot is downwardly inclined in the forward direction, the front or toe portion of the boot-upper 12 which is in contact with the small plate 14 thrusts this latter and correlatively the rods 15 towards the front end of the ski. In consequence, said rods in turn exert a thrust against the piston 4 in the direction opposite to the restoring force of the resilient member 6 on the piston 4. If the thrust exerted by the rods 15 on the piston 4 is of higher value than the restoring force of the spring 6, the piston 4 moves away from the cam 5 as shown in FIGS. 3 and 4. In consequence, the abutment member is capable of pivoting freely and thus permitting torsional release, which is opposed solely by the additional friction forces mentioned earlier. However, even if the thrust exerted by the rods 15 on the piston 4 is insufficient to move this latter away from the pivot 2, the inherent stiffness of release of the resilient device 6, 4 is nevertheless reduced to a distinctly lesser degree.

It will be noted that, during operation, the lateral arms 9 carry out a slight movement of pivotal displacement about their pins 16 under the pressure of the ski boot. This result is possible by reason of the presence of the elastically deformable seatings 17 into which the lower ends of the screws 18 are capable of penetrating (as shown in FIG. 4).

The result thereby achieved is to assist the forward displacement of the ski boot and consequently the displacement of the feeler member 13. However, this arrangement is by no means essential since the slight elasticity of the arms 9 and the inevitable deformability of the boot are sufficient to permit displacement of the feeler 13 even in the event of a simple axial thrust. In the event of a forward fall, action is necessarily produced on the feeler as a result of the inclination of the boot (as shown in FIG. 3) even if the jaw unit is perfectly rigid.

In the event of an axial thrust exerted by the boot towards the front end of the ski and arising essentially from braking of this latter as stated earlier, from bending of the ski or form faulty length adjustment of the ski binding, the feeler member 13 is displaced by the toe end of the ski boot 11 and produces action on the resilient device 6, 4, in the same manner as the procedure which has just been described with a view to reducing the stiffness of release.

It will be readily apparent that, in the event of a forward fall combined with an axial thrust, the feeler 13 is also actuated as in the previous instance.

In the embodiment shown in FIGS. 5 to 8, the feeler member consists of an assembly which is constituted by a force reduction device and by two longitudinal rods 21. Said rods are slidably mounted within the body 22 on each side of the stationary pivot 23 and the ends of said rods are in contact with the piston 24.

The force duration device is composed of two identical levers 25 pivotally mounted on vertical pins 26 mounted within the body 22. Said levers 25 are of the scissors type and are each provided at the end nearest the boot 11 with a slightly concave face 25*a* having a shape adapted to the sole 27 of the boot. Furthermore, these levers 25 are so arranged that, when they carry out a movement of pivotal displacement about their pins 26 towards the piston 24, they exert a longitudinal thrust on the rods 21 which in turn produce an axial displacement of the piston 24 in the direction opposite to the restoring force of the spring 6.

The rods 21 are engaged within an annular groove 28 providing a passageway and formed on the periphery of the pivot 23.

The arms 9 can be mounted either rigidly on the body 22 as is known in the prior art (see, for example, applicant's prior U.S. Pat. No. 3,578,804 or articulated on the body so as to be capable of a slight pivotal movement when the boot exerts a forward thrust on these latter. Resilient seatings are then provided in the body 22 as in the previous embodiment (FIGS. 1-4).

Figure 7:
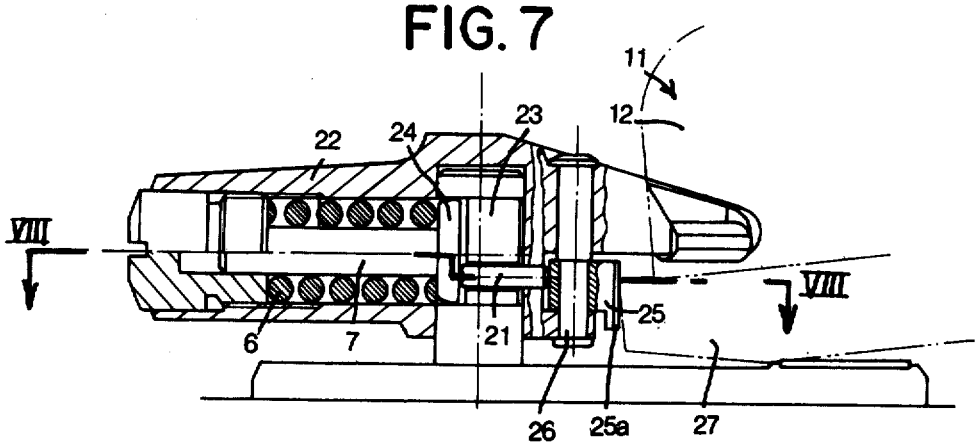
FIG. 7 is a view which is similar to FIG. 5 and shows the position of the feeler and of the piston in the case of a forward fall.
Figure 8:
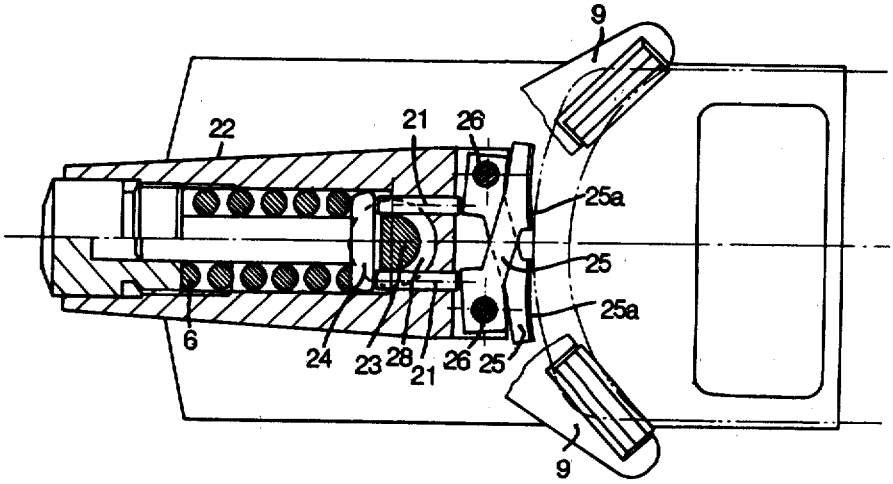
FIG. 8 is a sectional view taken along line VIII—VIII of FIG. 7.
Figure 9:
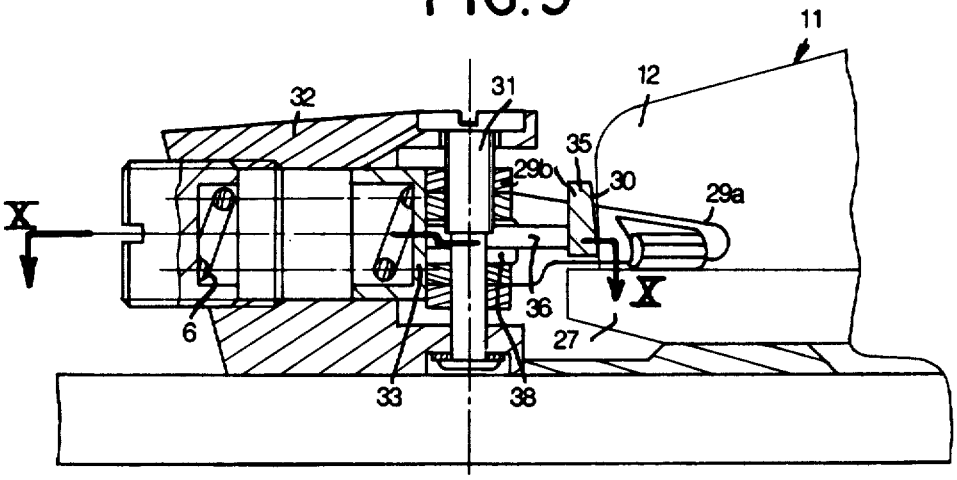
FIG. 9 is a front longitudinal sectional view of a third embodiment of the toe abutment member in accordance with the invention.
Figure 10:
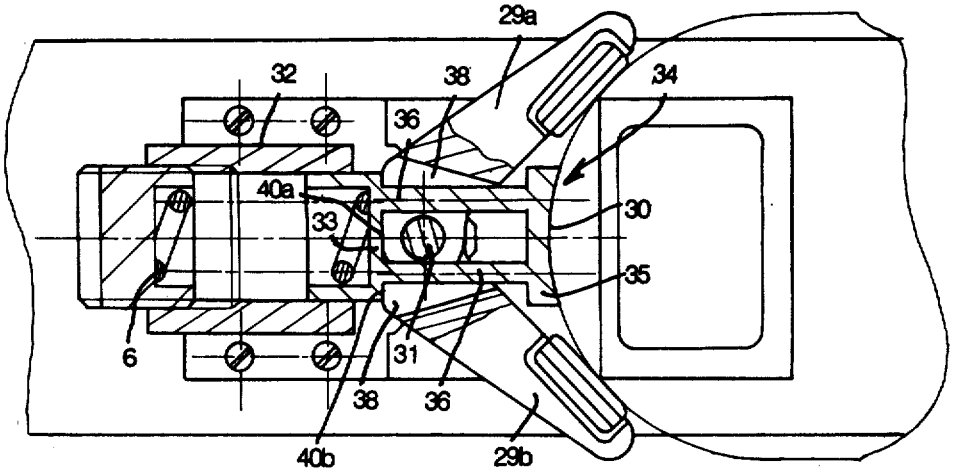
FIG. 10 is a top sectional view taken along line X—X of FIG. 9.

There is shown in FIGS. 7 and 8 the state of the abutment member at the time of a forward fall. It is apparent that the toe end of the sole 27 exerts a thrust on the levers 25 and causes these latter to pivot about their pins 26, thus producing an axial displacement of the rods 21 which tend to move the piston 24 away from its bearing cam.

Reduction of the force transmitted by the feeler member to the piston 24 is obtained by virtue of the fact that the line of action of the rods 21 passes between the bearing face of the sole 25*a* and the pivot-pin of the lever 25.

It is thus possible to dislodge the piston 24 from the pivot 23 even if the force applied to the levers 25 by the ski boot is of lower value than the restoring force of the spring 6.

In the third embodiment shown in FIGS. 9 to 12, the toe abutment member which is contemplated by the invention is of the type comprising two arms 29*a*, 29*b* pivotally mounted on a stationary pin 31 independently of each other. The pivot-pin 31 is carried by a body 32 mounted on the ski and has a threaded portion which permits height adjustment of the arms 29*a*, 29*b* in a known manner.

The body 32 contains a resilient device constituted by a spring 6 and by a piston 33 applied against profiled surfaces 40*a*, 40*b* which are preferably flat and formed on the levers 29*a*, 29*b*.

In accordance with the invention, the piston 33 is connected by means of rods 36 to a feeler member 34 constituted by a small plate 35 having a concave face 30 adapted to cooperate with the front portion 12 of the upper of the boot 11. Suitable apertures 38 formed in the arms 29*a*, 29*b* provide through-passages for the rods 36.

Figure 12:
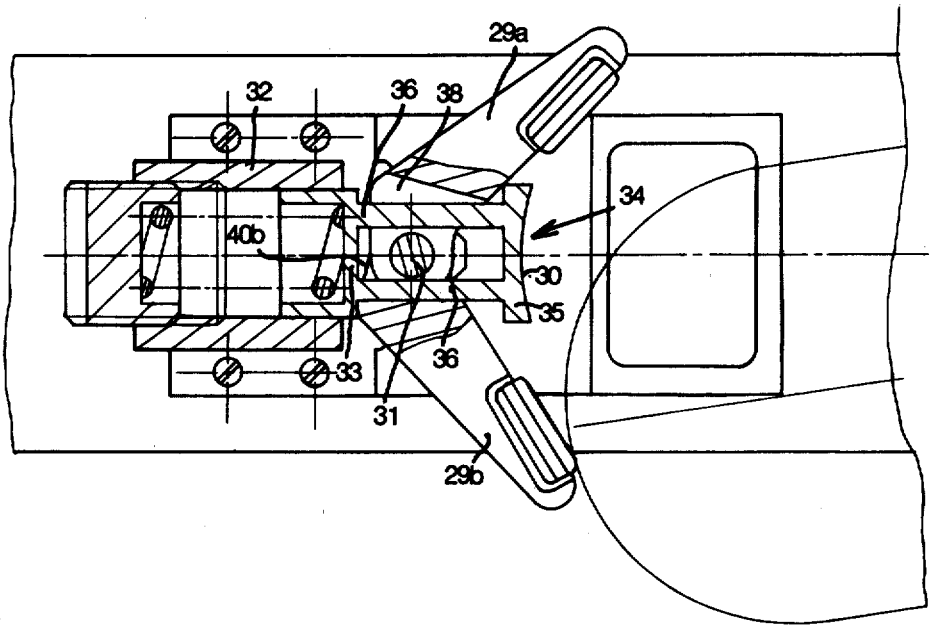
FIG. 12 is a view which is similar to FIG. 10 and shows the abutment member at the time of a fall occurring solely in a torsional or twisting movement.

FIG. 12 shows the operation of the abutment member during a simple twist or torsion in which the feeler member 34 in accordance with the invention does not play any part in order to show the functional independence of the arms 29*a*, 29*b* in this embodiment. In this figure, the skier's foot is subjected to a twisting movement in the direction of escape of the toe end of the boot towards the left-hand side of the ski. Under these conditions, the arm 29*b* pivots about the pin 31 whilst the profiled surface 40*b* displaces the piston 33 in opposition to the spring 6.

Similarly, a right-hand twist would produce a pivotal displacement of the arm 29*a* in opposition to the force of the spring 6.

Figure 11:
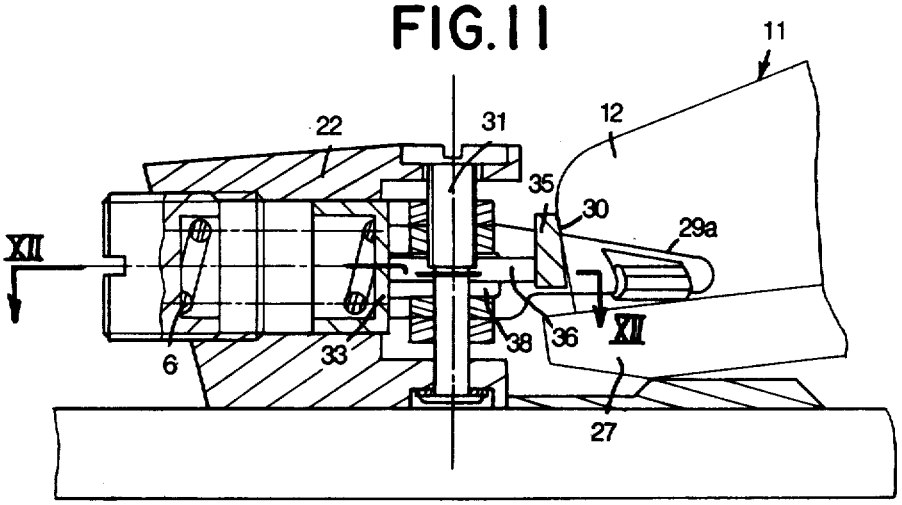
FIG. 11 is a view which is similar to FIG. 9 and shows the abutment member at the time of a forward fall.

In the event of a forward fall (as shown in FIG. 11) or in the event of an axial thrust, the toe end of the boot pushes the small plate 35 which in turn produces action on the piston 33 by means of the rods 36. The inherent stiffness of release exerted by the resilient device 6, 33 on the arms 29*a*, 29*b* is consequently reduced.

Figure 13:
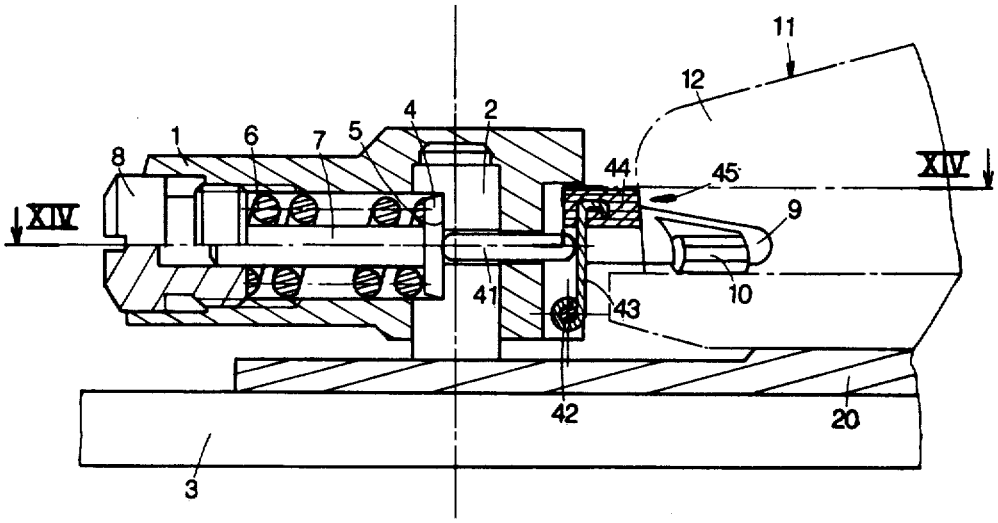
FIG. 13 is a front sectional view taken along line XIII—XIII of FIG. 14 and showing a fourth embodiment of an abutment member in accordance with the invention.
Figure 14:
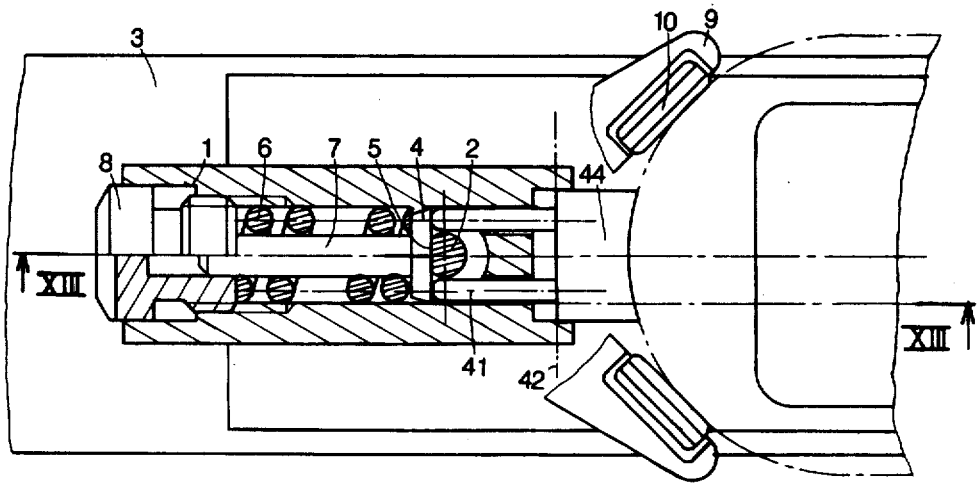
FIG. 14 is a top sectional view taken along line XIV—XIV of FIG. 13.

FIGS. 13, 14 show an embodiment in which the toe abutment member is similar to the abutment member of FIGS. 1 to 4 and in which the feeler member alone has been modified with respect to this latter. In fact, the feeler member 45 comprises a lever 43 constituted, for example, by a suitably bent sheet metal member. A bearing element 44 which is preferably formed of material having a low coefficient of friction such as PTFE is attached to said sheet metal member either by means of a clip or by overmolding. This arrangement makes it possible to obtain a reduction of the axial effort transmitted by the boot 11 to the piston 4 via the lever 43 and the sliding rods 41.

It will be noted that, in each of the embodiments hereinabove described, the lateral arms constituting the jaw unit of the toe abutment member are capable of arcuate lateral movement in order to permit torsional escape of the ski boot but nevertheless otherwise remain incapable of axial displacement towards the front end of the ski. This is essential in order to ensure that the boot is firmly maintained while skiing is in progress and consequently in order to prevent any accidental boot disengagements.

The invention is not limited to the embodiments hereinbefore described and may accordingly extend to alternative forms of construction. Thus the movement of the lateral arms of the abutment member is not necessarily a movement of rotation. For example, the movement of said arms could be a translational movement performed transversely with respect to the ski.

What is claimed is:

1. A toe abutment member for a ski binding, comprising a jaw unit constituted by two lateral arms intended to cooperate with the front portion of a ski boot in order to maintain said boot normally along the longitudinal axis of the ski, means mounting said arms for arcuate movement about a vertical axis with respect to said ski in order to permit lateral disengagement of the ski boot when an excessive twisting effort is exerted on the skier's leg, a resilient device normally maintaining said arms in a stationary boot-retaining position with a predetermined force designated as the inherent stiffness of release, a movable feeler member on said abutment member adapted to contact the front or toe portion of the boot, and means actuated upon movement of said feeler member to act upon said resilient device for reducing the inherent stiffness of release thereof whenever said feeler member is moved by the boot in response to a forward fall position of the skier and/or of an axial thrust exerted by the ski boot.

2. A toe abutment member according to claim 1, in which the means mounting said arms comprise a body, and means pivotally supporting said body on said ski about a vertical axis and wherein the resilient device comprises a piston slidably mounted within said body as well as a spring which produces action on the piston so as to apply said piston against a profiled surface designated as a cam and formed on said pivot.

3. A toe abutment member according to claim 2, wherein said member comprises at least one rod and preferably two rods slidably mounted within the body and interposed between the feeler member and the piston so as to ensure that the movement of the feeler member towards the front end of the ski is transmitted to the piston and moves said piston away from said cam.

4. A toe abutment member according to claim 2 or claim 6, wherein the piston has a flat head in cooperating relation with a cam in the form of a flat surface.

5. A toe abutment member according to claim 1, wherein the two lateral arms are functionally independent, only one of the two arms being capable of displacement in opposition to the resilient device during disengagement of the ski boot.

6. A toe abutment member according to claim 5, in which the means mounting said arms comprise a body, and means pivotally supporting said body on said ski about a vertical axis and wherein the resilient device comprises a piston slidably mounted within said body as well as a spring which produces action on the piston in order to apply said piston against profiled surfaces formed on each lateral arm.

7. A toe abutment member according to claim 1, wherein the feeler member is located at the level of the ski-boot upper and shaped so as to cooperate therewith.

8. A toe abutment member according to claim 1, wherein the feeler member is located at the level of the ski-boot sole and shaped so as to cooperate therewith.

9. A toe abutment member according to claim 1, wherein that face of the feeler member which is in contact with the ski boot has a substantially arcuate concave shape.

10. A toe abutment member according to claim 1, wherein motion transmission between the feeler member and the resilient device is effected by means of an effort reduction device.

11. A toe abutment member according to claim 10, wherein the feeler member is constituted by a lever pivotally mounted on a transverse pin movable with said lateral arms and longitudinally stationary with respect to said ski.

12. A toe abutment member according to claim 1 in combination with means interconnecting said lateral arms for movement as a single unit in opposition to the resilient device during disengagement of the ski boot.

13. A toe abutment member according to claim 12, in combination with means adjusting the relative spacing of said lateral arms to permit adaptation of the jaw unit to the dimensions of the ski boot.

14. A toe abutment member according to claim 1 in combination with means permitting limited resilient displacement of said lateral arms away from each other in the event of an axial thrust exerted by the ski boot within the jaw unit.

* * * * *